United States Patent [19]

Chambers

[11] 4,012,026

[45] Mar. 15, 1977

[54] APPARATUS FOR FORMING PLAQUES

[76] Inventor: Denzil G. Chambers, 2432 MacArthur Blvd., Apt. 104, Irving, Tex. 75062

[22] Filed: Jan. 27, 1975

[21] Appl. No.: 544,506

[52] U.S. Cl. ..... 249/134; 249/135; 249/140; 249/160

[51] Int. Cl.[2] ..... B28B 7/06

[58] Field of Search ..... 249/135, 168, 55, 83, 249/160, 104, 134, 112, 140; 164/45; 425/DIG. 57, 124, 175, 803, 2; 29/423; 264/222; 179/107

[56] References Cited

UNITED STATES PATENTS

| | | | |
|---|---|---|---|
| 837,757 | 12/1906 | Treleaven | 425/175 |
| 993,914 | 5/1911 | Truman | 249/157 |
| 2,611,170 | 9/1952 | Theis | 425/DIG. 124 |

*Primary Examiner*—Francis S. Husar
*Assistant Examiner*—John McQuade
*Attorney, Agent, or Firm*—Hubbard, Thurman, Turner & Tucker

[57] ABSTRACT

An apparatus is disclosed for forming plaques or castings of impressions of various articles. The disclosed apparatus includes a reusable impression frame and a molding frame to retain the mold composition as it hardens while in contact with the impression retaining means.

9 Claims, 7 Drawing Figures

APPARATUS FOR FORMING PLAQUES

This invention relates to an apparatus for forming plaques or casts. In another aspect, this invention relates to an improved apparatus for forming plaques or casts from impressions. In still another aspect, this invention relates to a reusable apparatus for forming plaques or casts utilizing impressions in an impression retaining means.

In recent years, the arts and crafts and hobby industry has grown to be an important industry in our economy. One particularly popular hobby or handicraft is the making of plaques or castings by forming a mold by pressing an object into an impression retaining means such as modeling clay and the like. Thereafter, a fluid material such as liquid plaster of Paris, liquid rubber and the like can be poured into the impression retaining means that has an impression therein. Following a period of curing or drying, the completed plaque or casting can be removed from the impression retaining means.

The above-mentioned method of forming plaques and castings is particularly popular among parents and children for forming souvenir plaques or castings of a child's hand or foot. Such castings or plaques have a considerable amount of sentimental value and indeed some parents and grandparents make large collections of such casts and plaques of their children and grandchildren.

Until recently, the making of plaques and castings as mentioned above has been complicated due to the fact that the mold apparatus was usually an expensive and bulky piece of equipment. In an effort to encourage the production of attractive plaques and castings using the above-mentioned technique, various supply houses have introduced impression molding kits that are somewhat more simple to use. However, such kits are relatively expensive to use since only one plaque or mold can be produced from each kit. Additionally, such nonreusable kits, having a prepared impression retaining means already disposed in the mold, have a very serious deficiency in that if a mistake or a bad impression is made in the impression retaining means, it is difficult if not impossible to remedy the problem prior to the casting step. This deficiency is particularly troublesome when impressions are made of the hands and feet of small children. Of course, small children are sometimes uncooperative and will quite often move in an unexpected manner while an impression is being made of a hand or foot, thereby ruining the impression. In such instances, if an impression is improperly made in one of the disposable molding kits, it is necessary to discard the entire kit and repeat the process with another kit. Even in those instances wherein presently available impression molding kits are produced to allow for the correcting of a bad impression prior to casting, the kit still can be utilized in most instances for only one casting. Therefore, it is apparent that it is not possible to make multiple impressions from existing molding kits, thus increasing the cost and inconvenience of impression molding by parents, children and other hobbyists.

It is, therefore, an object of this invention to provide an improved apparatus for forming plaques and castings. It is another object of the invention to provide an improved apparatus for forming plaques and castings using an impression molding technique wherein an impression is formed in an impression retaining means and a molding medium is applied thereto. It is still another object of this invention to provide an improved apparatus that can be utilized many times for the production of plaques and castings by an impression casting method.

The present invention is directed to an improved apparatus for forming plaques or castings using an impression molding technique wherein an impression retaining means is placed in one portion of the apparatus, the surface of the impression retaining means is prepared for mold forming and a suitable molding frame is placed over the impression retaining means, followed by the application of the molding medium. The instant apparatus includes a reusable frame for containing the impression retaining means. The impression frame allows for the multiple use of the impression retaining means and further allows for the smoothing of the surface of the impression retaining means for multiple impression forming steps without the necessity for removing the impression retaining means therefrom. The molding frame of the instant apparatus sealedly contacts the impression retaining means to provide the mold surfaces to facilitate the formation of the desired plaque or casting.

The instant invention can best be described by referring to the drawings wherein.

Figure 1:
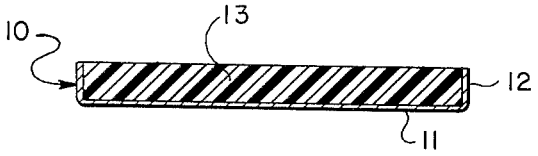
FIG. 1 is a cross-sectional view of one preferred impression frame with the plastic impression retaining means disposed therein, ready to receive an impression.

The impression frame of this invention is a relatively shallow tray or pan that serves to receive and contain a plastic impression retaining means which will be described in more detail hereinafter. The impression frame can be of any suitable configuration. One of the preferred shapes is a shallow cylindrical shaped tray or pan as is illustrated in the figures. The impression frame is made up of a base section and upstanding wall sections attached to the base to define an open top tray or pan. Since most plaques or articles made by impression molding having relatively shallow relief, the walls of the impression frame need not be particularly high, with the walls being only slightly higher than the maximum relief of the plaques or castings to be produced. For most applications wherein children's hands and feet are used to form the molds, the wall sections of the impression frame will be in the order of one inch in height.

As shown in FIGS. 1 through 6, impression frame 10 is comprised of a base section 11 and upstanding wall sections 12. The height of wall sections 12 will usually not be more than about 1 inch in height for normal plaque forming. However, if plaques having either greater or lesser relief are desired, wall sections 12 may be either greater or less than 1 inch.

A suitable plastic impression retaining means 13 is placed within impression frame 10 so as to form a body or mass of the plastic impression retaining means to receive and maintain an impression. Any suitable impression retaining means can be utilized in the instant invention. However, plastic impression retaining means such as modeling clay, glazing compound, putty, soft polymeric materials and the like are the most desirable types of impression retaining means for use in this invention. By using the foregoing impression retaining means, it will be apparent that they are sufficiently plastic to allow for the production of clean distinct impressions, showing minute details of the impressed article. Additionally, such materials can be reused since they do not harden and loose their plastic characteristics over long periods of time.

In a preferred embodiment, the impression retaining means 13 is added to impression frame 10 in such a quantity as to completely fill impression frame 10 to a height that is approximately equal to the height of upstanding wall sections 12. By filling impression frame 10 with such an amount of impression retaining means 13, it is quite convenient to smooth the top surface of impression retaining means 13 by means of a roller or other object that can be rolled or drawn across the upper surface of impression retaining means 13 while being guided by the upper edges of upstanding wall sections 12. Since most plaques made with the apparatus described are decorative type plaques, it is quite important that the exposed surface of the impression retaining means 13 be properly prepared prior to impressing the object to be duplicated into the surface thereof. If desired, the surface of impression retaining means 13 can be patterned or textured to give the plaque or casting an unusual effect.

Figure 2:
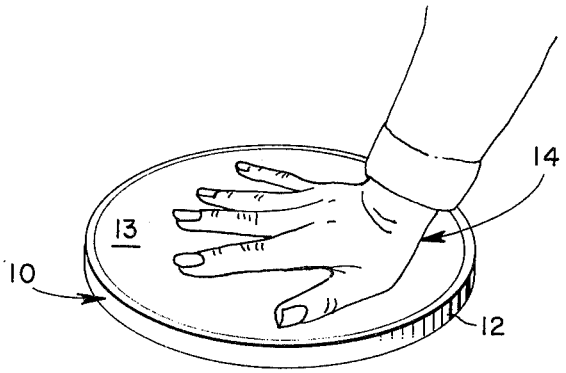
FIG. 2 is a side perspective view of the impression frame of FIG. 1 showing the application of an impression in the plastic impression retaining means.

After the exposed surface of impression retaining means 13 has been properly prepared with the desired smooth surface or otherwise textured, the desired impression can be made in the surface of impression retaining means 13. For purposes of illustration, FIG. 2 illustrates the impression of a child's hand 14 into the surface of impression retaining means 13. By applying a suitable amount of pressure, child's hand 14 will sink into the surface of impression retaining means 13 and upon withdrawal, impression **14*a* will remain in the surface of impression retaining means 13**.

If the impression is not properly formed, the surface of impression retaining means 13 can be very easily reprepared for an additional impression by simply rolling the surface of impression retaining means 13 or by using a suitable spatula or other device to smooth the surface fr a subsequent impression. This feature represents an important improvement over several prior art systems wherein it is difficult if not impossible to reprepare the surface of impression retaining means when the user is not satisfied with the impression initially made.

Following the formation of impression **14*a*, molding frame 15 is placed in position for the molding step. Molding frame 15 is formed by an upstanding wall section that defines a continuous wall section with open ends. The size of molding frame 15 is such that it will fit within upstanding walls 12 of impression frames 10. In the illustrated embodiment, it is noted that molding frame 15 has a slightly smaller diameter than the wall section 12 of impression frame 10. Thus, the smaller diameter molding frame 15 fits inside upstanding wall section 12 of impression frame 10**.

Figure 3:
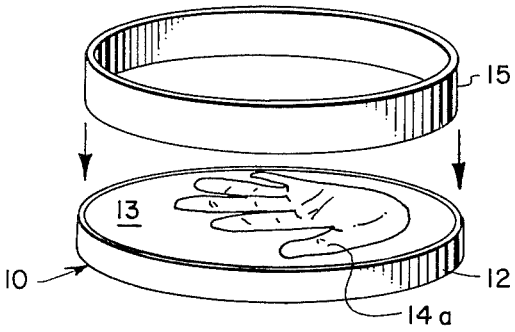
FIG. 3 is a side perspective view illustrating the relationship of the impression frame and the molding frame as the apparatus is being assembled in preparation for molding.
Figure 4:
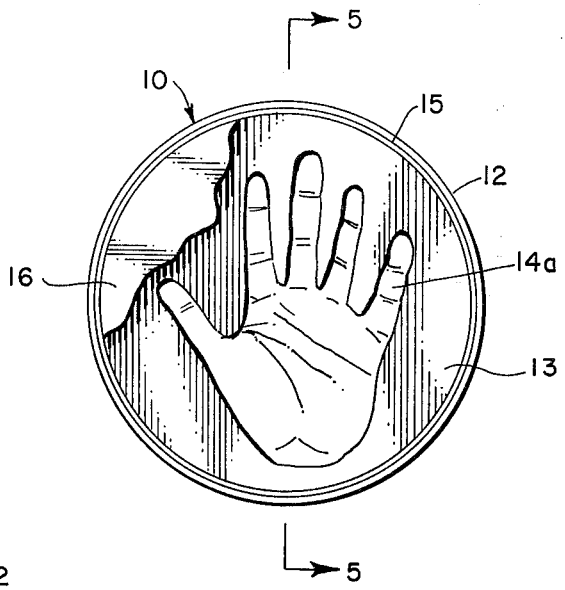
FIG. 4 is a top view of the assembled apparatus for the invention, showing the relative locations of the impression frame, the impression retaining means and the molding frame with a portion of the molding medium cut-away to show the impression below the molding medium.

FIG. 3 illustrates the relationship of molding frame 15 with respect to impression frame 10 as the apparatus is being assembled for molding. Once molding frame 15 is in position within the upstanding wall sections 12 of impression frame 10, pressure is applied in a downward direction to force the lower edge of molding frame 15 into the plastic impression retaining means 13.

Figure 5:
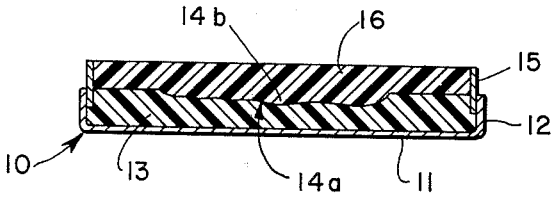
FIG. 5 is a cross-sectional view taken along lines 5—5 of FIG. 4.
Figure 6:
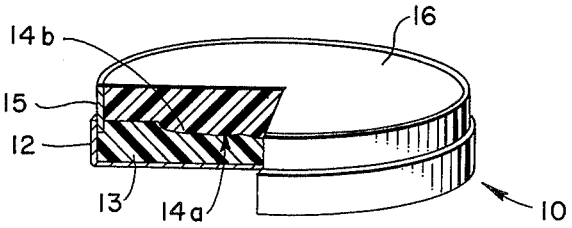
FIG. 6 is a side perspective view of the impression frame, the molding frame and the plastic impression retaining means, with a portion broken away to illustrate the relationship of the components with the setable liquid molding medium in the assembled apparatus.

As shown in FIGS. 5 and 6, the downward force on molding frame 15 will cause the lower edge of molding frame 15 to sink and become buried in impression retaining means 13. Thus, the lower edge of molding frame 15 is sealedly engaged in plastic impression retaining means 13 around the lower periphery of molding frame 15. As a result of the sealed engagement of molding frame 15 with impression retaining means 13, a mold is formed for subsequent filling by liquid molding medium 16. The mold is defined by the surface of plastic impression retaining means 13, with suitable impression **14*a* therein and the upstanding walls of molding frame 15. Since fluid molding medium 16 will be poured or forced into the mold, it will be apparent that the upstanding wall section of molding frame 15 should be sufficiently high to contain a sufficient amount of the molding medium to produce a plaque of the desired thickness. Normally, the upstanding walls of molding frame 15 should rise at least about ½ inch above the surface of impression retaining means 13, after the lower edges of the molding frame have been sealedly engaged with the surface of impression retaining means 13**.

Following the application of molding frame 15 to sealedly engage the surface of impression retaining means 15, the mold is ready for filling with the desired liquid molding medium 16. In some instances, it may be desirable to apply a light coating of a mold release agent to the surface of impression retaining means 13 and the upstanding walls of molding frame 15 to facilitate a separation of the molded plaque from the mold itself.

Any suitable molding medium can be utilized so long as it is compatible with impression retaining means 13 and molding frame 15. One particularly suitable type of molding medium is plaster of Paris. Of course, other types of molding mediums including gypsum cement, acrylic plastics, rubber solutions and the like can also be utilized as the molding medium. After the liquid molding medium is poured into the mold to the desired depth, it may be desirable to vibrate the mold filled with the liquid molding medium to ensure the proper filling of all depressions of the mold with the molding medium. Such vibtating will also aid in preventing undesirable bubbles and voids from forming in the casting or plaque. In some instances the molding medium may be semi-solid plastic material that can be packed or forced into the mold. The depth to which the molding medium is added to the mold is entirely a matter of choice.

In some instances it may be desirable to add hanging hooks or loops to the back of the plaque while the molding medium is still in a liquid or plastic state. These hanging hooks and loops can be merely pressed into the liquid or plastic molding medium before it cures. Upon curing, the hanging hooks and loops will be bonded to the back of the plaque.

Following a period of preliminary curing, the molding medium will "set" to form the impression molded plaque. Thereafter, the plaque can be removed from the apparatus by simply removing molding frame 15 by lifting it upwardly from the impression frame. In those instances where the completed plaque adheres to molding frame 15, it may be necessary to tear or peel molding frame 15 from the edges of the plaque.

Figure 7:
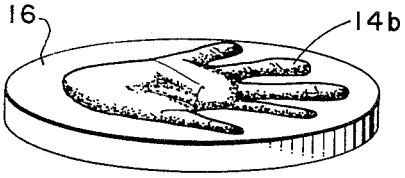
FIG. 7 is a side perspective view of a completed molded plaque produced with the apparatus illustrated in FIGS. 1 through 7.

FIG. 7 is a perspective view of a completed plaque after molding frame 15 has been removed therefrom showing the raised relief **14*b* that was formed when molding medium 16 filled impression 14*a***. Of course, the completed plaques can be painted or sealed in any desired manner following their removal from the apparatus of this invention.

As will be apparent to those skilled in the art, the instant apparatus is especially suited for sale in a kit form wherein the impression frame, molding frame and impression retaining means can be sold as a unit. The user can then produce impression molded plaques as described above by simply preparing the desired impression mold and filling it with a suitable molding material such as plaster of Paris. The impression frame can be utilized over and over by simply preparing the surface of impression retaining means 13 for impressions as desired. In some instances it may be desired to make multiple plaques or castings from a single impression. This can be accomplished by merely removing each curved plaque from the surface of impression retaining means 13 and repeating the above-described process by applying molding frame 15 and filling the mold with the molding medium.

It is desirable that impression frame 10 be constructed of some durable material such as rigid plasticm, light gauge metal and the like. Molding frame 15 can also be constructed of such materials. However, in those instances where a molding medium is utilized that expands upon curing, it may be desirable to produce molding frame 15 of a material that can be torn or cut from the cured molded plaque. Thus, molding frames 15 can be in the form of thin plastic, heavy paper, cardboard and the like.

It will be apparent to those skilled in the art that the apparatus illustrated in the figures does not have to be in the form of circular impression frames and molding frames. Any desired configuration can be utilized. Since the molding frame sealedly engages the impression retaining means in the impression frame, it is, of course, possible to utilize molding frames having a variety of shapes with a single impression frame. Thus, a kit may be marketed having a relatively large impression frame with a variety of molding frames of differing configurations such as circles, ellipses, and various polygons.

In one of the preferred embodiments of this invention, the molding frame can be of a deformable material that can be bent or shaped into any desired configuration such as in the shape of a heart, or other novelty type shapes. Of course, the molding frame should be bent or shaped into a form that will still fit within the impression frame to contact the impression retaining means contained therein. Suitable deformable materials include light gauge metal, thin plastic, heavy paper, cardboard and the like.

It will be apparent to those skilled in the art that many different modifications and changes may be made in the foregoing disclosure and thus it must be appreciated that such changes and modifications can be made or followed without departing from the spirit and scope of this invention.

I claim:

1. An apparatus for producing plaques by impression molding comprising:

a. an impression frame having a base section and upstanding wall sections;

b. a plastic impression retaining means capable of receiving and retaining an impression, said impression retaining means being disposed within said impression frame and supported by the base of said impression frame; and c. a molding frame having upstanding walls defining a continuous wall section with open ends, said molding frame fitted wholly within the upstanding wall sections of said impression frame and supported by said plastic impression retaining means such that the lower edge of said continuous wall section sealedly engages said plastic impression retaining means with the upper edge of said continuous wall section extending above said plastic impression retaining means thereby forming the mold defined by the surface of said plastic impression retaining means and the upstanding continuous wall section of said molding frame.

2. The apparatus of claim 1 wherein said plastic impression retaining means is disposed within said impression frame in an amount to fill said impression frame to a depth so that the top of said plastic impression retaining means is about level with the top of the upstanding wall sections of said impression frame.

3. The apparatus of claim 1 wherein said impression frame as a circular base with upstanding walls to form a generally cylindrical form with an open top.

4. The apparatus of claim 1 wherein said molding frame is in the form of a cylinder with open ends.

5. The apparatus of claim 1 wherein said molding frame is a deformable material capable of being bent or shaped into a desired configuration.

6. The apparatus of claim 5 wherein said deformable material is light gauge metal.

7. The apparatus of claim 5 wherein said deformable material is thin plastic.

8. The apparatus of claim 5 wherein said deformable material is heavy paper.

9. The apparatus of claim 5 wherein said deformable material is cardboard.

* * * * *

UNITED STATES PATENT AND TRADEMARK OFFICE

CERTIFICATE OF CORRECTION

PATENT NO. : 4,012,026

DATED : March 15, 1977

INVENTOR(S) : Denzil G. Chambers

It is certified that error appears in the above-identified patent and that said Letters Patent are hereby corrected as shown below:

Under ABSTRACT, "mold" should be --molding--.

Column 2, Line 38, "for" should be --of--.

IN THE CLAIMS: Claim 3, Line 46, "as" should be --has--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*